US012410589B2

(12) United States Patent
Tevis et al.

(10) Patent No.: US 12,410,589 B2
(45) Date of Patent: Sep. 9, 2025

(54) METHODS AND SYSTEMS FOR IMPLEMENTING A LOCK-OUT COMMAND ON LEVER MACHINES

(71) Applicant: Caterpillar Inc., Peoria, IL (US)

(72) Inventors: Ethan M. Tevis, Bloomington, IL (US); Michael C. Gentle, Maroa, IL (US); Travis N. Richards, Chillicothe, IL (US); Michael L Repscher, Taylorville, IL (US); Ernest E. Stoops, Mt. Zion, IL (US)

(73) Assignee: Caterpillar Inc., Peoria, IL (US)

( * ) Notice: Subject to any disclaimer, the term of this patent is extended or adjusted under 35 U.S.C. 154(b) by 856 days.

(21) Appl. No.: 17/458,033

(22) Filed: Aug. 26, 2021

(65) Prior Publication Data

US 2023/0064337 A1 Mar. 2, 2023

(51) Int. Cl.

| | |
|---|---|
| ***E02F 9/24*** | (2006.01) |
| ***E02F 9/20*** | (2006.01) |
| ***E02F 9/22*** | (2006.01) |
| ***E02F 9/26*** | (2006.01) |

(52) U.S. Cl.

CPC ..... *E02F 9/24* (2013.01); *E02F 9/2029* (2013.01); *E02F 9/2033* (2013.01); *E02F 9/2087* (2013.01); *E02F 9/225* (2013.01); *E02F 9/262* (2013.01); *E02F 9/2267* (2013.01)

(58) Field of Classification Search

CPC ..... E02F 9/24; E02F 9/2029; E02F 9/2033; E02F 9/2087; E02F 9/225; E02F 9/262; E02F 9/2267

USPC ..... 701/50

See application file for complete search history.

(56) References Cited

U.S. PATENT DOCUMENTS

| | | | | |
|---|---|---|---|---|
| 5,957,989 | A | 9/1999 | Egawa et al. | |
| 6,231,296 | B1 * | 5/2001 | Blomgren | E02F 3/3663 403/324 |
| 6,269,637 | B1 | 8/2001 | Motomura et al. | |
| 6,415,604 | B1 | 7/2002 | Motomura et al. | |

(Continued)

FOREIGN PATENT DOCUMENTS

| | | | | |
|---|---|---|---|---|
| CA | 2810051 | A1 * | 9/2014 | E02F 9/24 |
| CN | 109440852 | A * | 3/2019 | E02F 9/00 |

(Continued)

*Primary Examiner* — Fadey S. Jabr
*Assistant Examiner* — Ahmed Alkirsh

(57) ABSTRACT

A technique is directed to methods and systems of an implement lock-out on lever-controlled machines. A lock-out system can monitor the position of an implement and lock-out the implement control(s) when the implement is within a threshold distance to parts of the machine. The lock-out system can generate an implement lock-out to slow, stop, or reduce the force of a hydraulic valve(s) controlling the implement. The lock-out system can use inputs such as electronic fence blade position system data, articulation angles, wheel lean angles, steering angles, ripper positions, mode selection or similar data to determine to generate the implement lock-out. The lock-out system can generate the implement lock-out by a flow supply shutoff to the implement while maintaining pressure to the steering valve. The lock-out system can send visual or audible notifications to alert the operator of the implement's proximity to the machine or of an implement lock-out.

20 Claims, 10 Drawing Sheets

(56) References Cited

U.S. PATENT DOCUMENTS

| | | | | |
|---|---|---|---|---|
| 6,757,992 | B1 * | 7/2004 | Berger | E02F 3/405 701/50 |
| 8,275,524 | B2 * | 9/2012 | Krause | E02F 3/844 701/50 |
| 9,238,900 | B2 | 1/2016 | Matsumoto et al. | |
| 10,815,640 | B2 | 10/2020 | Naito | |
| 2009/0185888 | A1 * | 7/2009 | Lin | E02F 9/226 701/50 |
| 2017/0284063 | A1 * | 10/2017 | Fukuda | E02F 9/2235 |
| 2017/0364629 | A1 * | 12/2017 | Tarte | B60Q 1/143 |
| 2017/0364869 | A1 * | 12/2017 | Tarte | G06Q 10/1095 |
| 2020/0080851 | A1 * | 3/2020 | Edwards | G01C 21/343 |
| 2020/0087893 | A1 * | 3/2020 | Hageman | E02F 9/268 |
| 2020/0172384 | A1 | 6/2020 | Cadou | |

FOREIGN PATENT DOCUMENTS

| | | | | | |
|---|---|---|---|---|---|
| JP | 2000213006 | A * | 8/2000 | | |
| JP | 2003147799 | A * | 5/2003 | | E02F 9/2033 |
| WO | WO-0032880 | A1 * | 6/2000 | | E02F 9/2033 |

* cited by examiner

METHODS AND SYSTEMS FOR IMPLEMENTING A LOCK-OUT COMMAND ON LEVER MACHINES

BACKGROUND

Users may operate machinery such as earthmoving or construction equipment in worksite environments. However, as a user operates the machine, implements to the machine, such as a blade, ripper, or bucket, can potentially cause damage to the machine and/or operator if the operator errs and moves the implement into the machine. Safety for operators and protecting equipment are growing concerns in the industry, and companies have implemented prevention techniques to protect operators and equipment from dangerous events. For example, U.S. Pat. No. 9,238,900B2 describes a method for driving a boom actuator of a front loader which adjusts pivot angles and scoop angles to prevent inadvertent contact between the bucket and the boom. However, this method is only directed to detecting a stop angle to keep the bucket from contacting the boom. Additionally, U.S. Pat. No. 10,815,640B2 describes a method for causing a wheel loader to raise the boom to avoid a collision with the loading target. However, this method is only directed to increasing the engine speed to provide the hydraulic pump with enough power to lift the bucket to a determined height to avoid the collision.

SUMMARY

In some embodiments, a method for implement lock-out on lever-controlled machines, such as earthmoving or construction equipment, includes receiving machine feature measurements for a lever-controlled machine operating at a site and determining whether the machine feature measurements are within a measurement threshold. In response to the machine feature measurements being within the measurement threshold, the method can include generating an implement lock-out of at least one hydraulic implement on the lever-controlled machine, wherein the implement lock-out at least one of slows or stops a flow supply to the hydraulic implement on the lever-controlled machine. The operator of the lever-controlled machine can have a steering capability during the implement lock-out. The method can further include sending, to the operator of the lever-controlled machine, a notification of the implement lock-out and disabling the implement lock-out on the lever-controlled machine after a time threshold.

In some embodiments, a system for implement lock-out on lever-controlled machines, such as earthmoving or construction equipment, include a machine and one or more non-transitory computer-readable media. The system can include receiving machine feature measurements for a lever-controlled machine operating at a site and determining whether the machine feature measurements are within a measurement threshold. In response to the machine feature measurements being within the measurement threshold, the system can generate an implement lock-out of at least one hydraulic implement on the lever-controlled machine, wherein the implement lock-out at least one of slows or stops a flow supply to the hydraulic implement on the lever-controlled machine. The operator of the lever-controlled machine can have a steering capability during the implement lock-out. The system can further include sending, to the operator of the lever-controlled machine, a notification of the implement lock-out and disabling the implement lock-out on the lever-controlled machine after a time threshold.

In some embodiments, the machine can further include one or more processors; and one or more memory devices having stored thereon instructions that when executed by the one or more processors cause the one or more processors to perform at least one of the following: (i) receive machine feature measurements for a lever-controlled machine operating at a site; (ii) determine the machine feature measurements are within a measurement threshold; (iii) in response to the machine feature measurements being within the measurement threshold, generating an implement lock-out of at least one hydraulic implement on the lever-controlled machine, wherein the implement lock-out at least one of slows or stops a flow supply to the hydraulic implement on the lever-controlled machine, wherein an operator of the lever-controlled machine has a steering capability during the implement lock-out; (iv) send, to the operator of the lever-controlled machine, a notification of the implement lock-out; and (v) disable the implement lock-out on the lever-controlled machine after a time threshold.

In some embodiments, the machine can further include an apparatus with a memory; one or more processors electronically coupled to the memory and configured to: (i) receive machine feature measurements for a lever-controlled machine operating at a site; (ii) determine the machine feature measurements are within a measurement threshold; (iii) in response to the machine feature measurements being within the measurement threshold, generating an implement lock-out of at least one hydraulic implement on the lever-controlled machine, wherein the implement lock-out at least one of slows or stops a flow supply to the hydraulic implement on the lever-controlled machine, wherein an operator of the lever-controlled machine has a steering capability during the implement lock-out; (iv) send, to the operator of the lever-controlled machine, a notification of the implement lock-out; and (v) disable the implement lock-out on the lever-controlled machine after a time threshold.

Other aspects will appear hereinafter. The features described herein can be used separately or together, or in various combinations of one or more of them.

BRIEF DESCRIPTION OF THE DRAWINGS

The techniques introduced here may be better understood by referring to the following Detailed Description in conjunction with the accompanying drawings, in which like reference numerals indicate identical or functionally similar elements.

DETAILED DESCRIPTION

Figure 1:
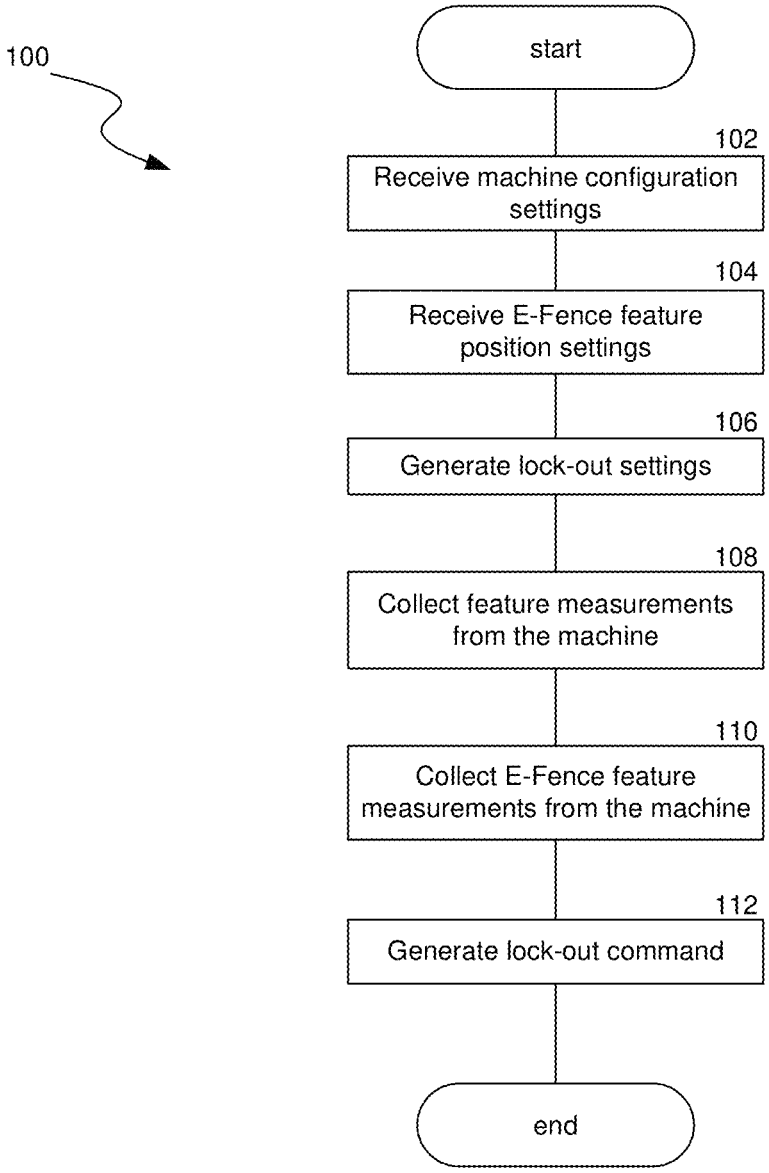
FIG. 1 is a flow diagram illustrating a process used in some implementations for generating an implement lock-out.

Aspects of the present disclosure are directed to methods and systems for an implement lock-out on lever-controlled machines such as earthmoving or construction equipment. In some implementations, operators control one or more implements (e.g., blades, rippers, buckets, adapters, augers, bale grabs, brooms, bale spears, brush-cutters, etc.) with lever controls. Note that while this description will refer to a single implement, the singular implicates the plural and multiple implements could be involved. As the operator moves the various levers, the levers activate hydraulic valves that control the machine implement, as there is a direct mechanical connection from the operator input lever to flow control on the implement hydraulic valves. In some cases, the operator can inadvertently move the implement in a way that causes damage to the machine or parts (e.g., wheels, cab, attachments, etc.) of the machine. For example, an operator of a motor grader causes the blade to collide with a tire on the machine.

In an embodiment, a lock-out system monitors the position of the implement and locks-out the implement controls when the implement is within a threshold distance (e.g., any distance, such as 0.5 inches, 1 inch, 6 inches, 12 inches, etc.) to parts of the machine. The lock-out system can generate an implement lock-out to slow, stop, or reduce the force of hydraulic actuator(s) for the implement based on machine control logic, such as independent of operator input. In some cases, the machine control logic is used when a feature is assisting the operator with training or protecting the machine from damage. The machine control logic can use inputs such as electronic fence (E-fence) blade position system, articulation angle, wheel lean angle, steering angle, ripper position, mode selection or similar data to determine to generate the implement lock-out. The lock-out system can generate the implement lock-out by a flow supply shutoff to the hydraulic actuator(s) for the implement or by a load sense shutoff. In a flow supply shutoff to the implement, the steering system still receives a hydraulic flow supply, which permits the operator to maintain steering capability of the machine during the implement lockout.

In some embodiments, the lock-out system can lock-out the implement controls by a load sense shutoff. In a load sense shutoff, the lock-out system will reduce the pressure or flow from the implement hydraulic actuator(s) back to the pump which will reduce the implement pressure to a standby value. For example, during a lock-out, as an implement control is moved (e.g., blade is raised on a machine), the lock-out system will keep the pressure low enough so the hydraulic valve does not move the implement. In some embodiments, the lock-out system can lock-out the implement controls by a solenoid or pilot command shutoff for electro-hydraulic controls. For example, during a lock-out, the lock-out system keeps the spool shifted only to steering so that the solenoid can manually lock-out the mechanical lever controls with an electronic feature.

The lock-out system can send notifications (e.g., visual or audible warnings, such as flashing lights, vibration in the operator's seat, vibration in the control levers or steering instrument, or an alarm) to alert the operator of the implement's proximity to the machine. The notification can alert the operator to the implement lock-out and the duration of the implement lock-out. In some implementations, the operator activates the lock-out command on the implement controls. For example, as the operator navigates the machine at a worksite or along a road, the operator can lock-out the implement controls to prevent the implement from damaging the machine.

Several implementations are discussed below in more detail with reference to the figures. FIG. 1 is a flow diagram illustrating a process 100 used in some implementations for generating an implement lock-out. In an embodiment, process 100 is triggered by any of the machine powering on, a user (e.g., operator) pressing a button on a control device or inputting a command, attaching an implement to a machine, the type of implement on a machine, the type of machine, or process 100 is always operating while the machine is powered on. Examples of suitable machines are, but not limited to, bulldozers, excavators, trenchers, loaders, backhoes, compactors, graders, feller bunchers, graders, wheel tractor scrapers, skid-steer loaders, dump trucks, cranes, telehandlers, pavers, and pile-driving/boring machines.

At step 102, process 100 receives machine configuration settings for the lever-controlled machine in operation. The machine configuration settings can include the tire size, rim size, blade length, attachments, the articulation angle, wheel lean angle, steering angle, ripper position, front attachment position, mid mount scarifier position, engine speed, transmission gear, output speed, and the feature and/or mode selection. The feature and/or mode selection can include machine autopilot or operator assist switched on/off, bound box settings around the machine for protection, or aggressive settings.

At step 104, process 100 receives E-Fence feature position settings. The E-Fence feature position settings indicate the position and orientation of the parts, attachments, and the implement of a machine. Process 100 uses the E-fence position settings to monitor the machine and the implement on the machine while the machine is operating. The E-Fence feature position settings can indicate a detection zone (e.g., protection zone) around the parts of the machine which is created by sensors. For example, the sensors detect if an implement is within a threshold distance to a part of the machine, such as the blade is within a threshold distance to a wheel.

At step 106, process 100 generates implement lock-out parameters for the machine using the E-Fence position settings and/or the machine configuration settings. Process 100 can generate a threshold distance that if the implement is within, an alarm or lock-out is triggered. Process 100 can determine the duration of an implement lock-out based on the E-Fence position settings and/or the machine configuration settings. The E-Fence position settings and/or the machine configuration settings can indicate the duration of the lock-out based on the type of machine, type of implement, or the proximity of the implement to the machine. In an example, if the implement comes within a determined distance (e.g., any distance, such as an inch, foot, etc.) to the machine, the lock-out requires a manual reset by the operator. In another example, if the implement comes within a determined distance to the machine, the implement lock-out remains active for a duration (e.g., 5 sec, 10 sec, etc.) and deactivates after the duration is complete. In some embodiments, the implement lock-out can remain active until the operator acknowledges (e.g., presses a button, flips a switch, etc.) the lock-out.

At step 108, process 100 collects feature measurements from the machine. Process 100 can collect feature measurements (e.g., tire size, rim size, blade length, attachments, the articulation angle, wheel lean angle, steering angle, ripper position, front attachment position, mid mount scarifier position, engine speed, transmission gear, and/or output speed) from the machine and compare the current measurements to the feature settings. If one or more of the feature measurements are greater by a threshold amount than one or more of the corresponding feature settings, process 100 can generate an implement lock-out.

At step 110, process 100 collects E-Fence feature measurements from the machine. The E-fence feature measurements can indicate the position and orientation of the implement in relation to the machine. For example, the E-Fence feature measurements indicate the distance from the implement to the machine or machine part, such as the distance from a blade to a tire on the machine. Process 100 can compare the E-fence feature measurements to the machine feature measurements to determine the distance from the implement to the machine or a part of the machine.

At step 112, process 100 generates the implement lock-out command for the hydraulic valves on lever-controlled machine.

Figure 2:
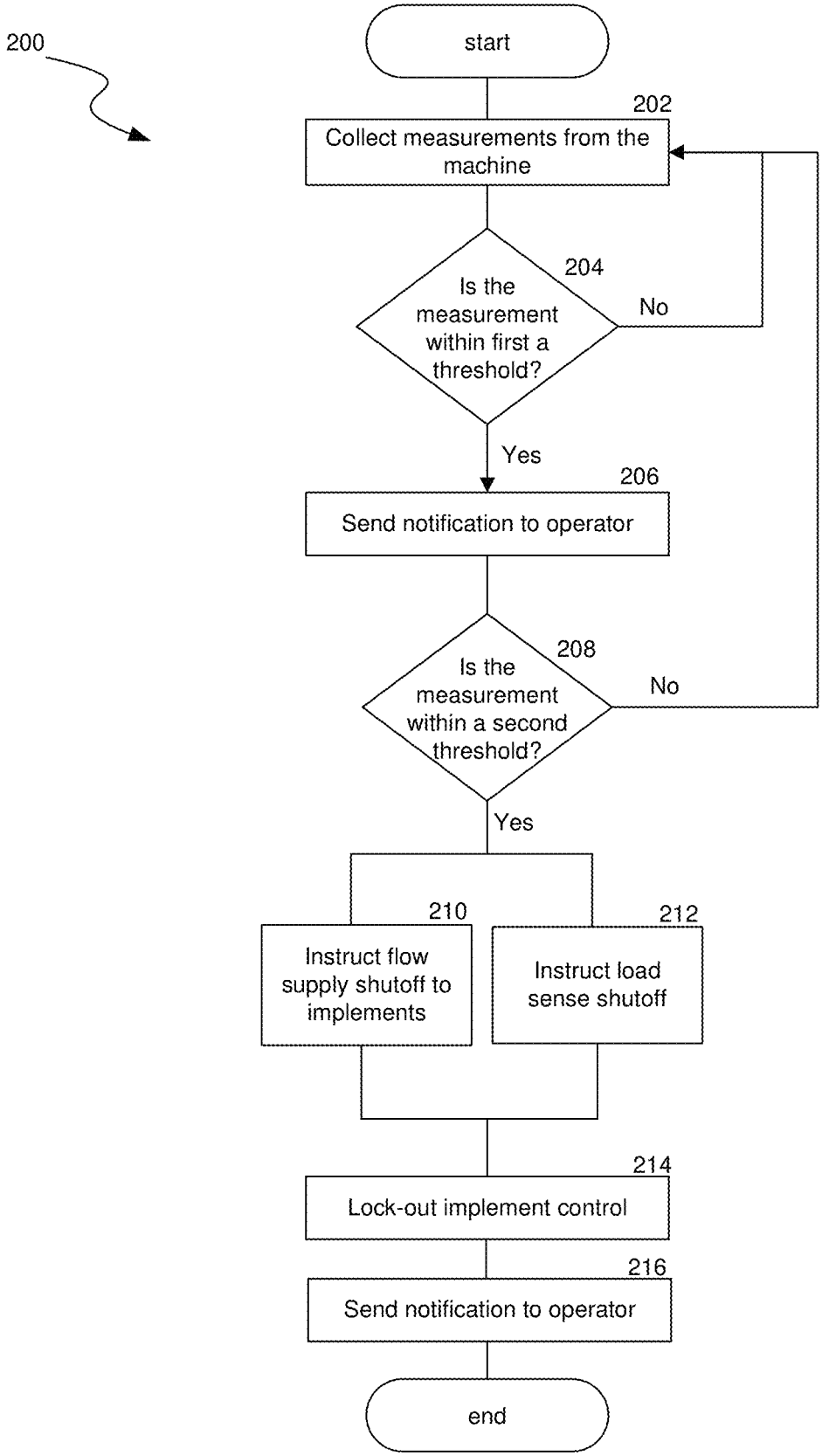
FIG. 2 is a flow diagram illustrating a process used in some implementations for locking out an implement control.

FIG. 2 is a flow diagram illustrating a process 200 used in some implementations for locking out an implement control. In an embodiment, process 200 is triggered by any of the machine powering on, a user (e.g., operator) pressing a button on a control device or inputting a command, attaching an implement to a machine, the type of implement on a machine, the type of machine, or process 200 is always operating while the machine is powered on.

At step 202, process 200 collects measurements from the machine. The measurements can include the machine feature measurements and the E-Fence feature measurements as describes at steps 108 and 110 of FIG. 1. At step 204, process 200 determines whether the measurements are within a first threshold. When the measurements are not within the first threshold (e.g., indicating the implement is within a safe operating distance from the machine features), process 200 can continue to collect measurements at step 202.

At step 206, process 200 sends a notification to the operator when the measurements are within a first threshold, indicating the orientation and position of the implement in relation to the machine. The first threshold distance can serve as a "warning" zone to alert the operator to the proximity of the implement to a part of the machine. If the operator adjusts the position or orientation of the implement to shift outside the first threshold, process 200 will continue to collect measurements and monitor the position and orientation of the implement.

At step 208, process 200 determines whether the measurements are within a second threshold. If the measurements are within a second threshold, process 200 can generate a lock-out by instructing either a flow supply shutoff to the implement or a load sense shutoff. At step 210, process 200 instructs a flow supply shutoff to the implement. A flow supply shutoff to the implement can indicate a priority spool has shifted to steering only. For example, as the operator moves a lever, the direct mechanical connection from the operator input lever to flow control on the implement hydraulic valves is interrupted so that the implement is unable to move. Maintaining steering capability permits the operator to navigate the machine without an implement causing damage to the machine. For example, during a lock-out, the operator can move the motor grader without the blade contacting a tire on the motor grader. A flow supply shutoff can close off the machine's main flow going to the implement. The main flow can go to the priority spool and whatever flow the steering does not use is available to the implement(s). For example, the flow supply shutoff would block the flow with a solenoid valve or a signal that shifts the priority spool to only allow steering to receive flow.

Figure 9:
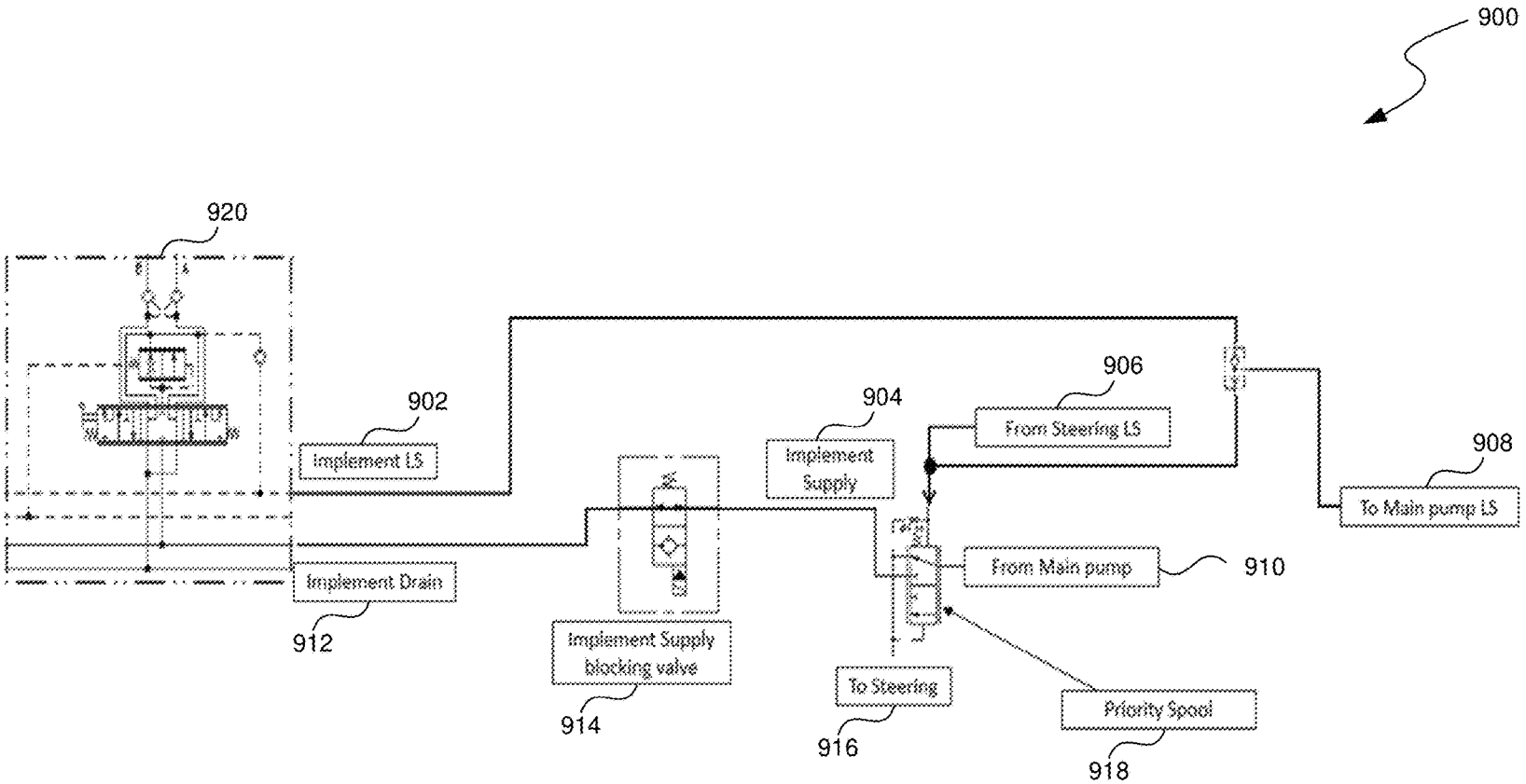
FIG. 9 is a schematic diagram illustrating an example of an implement supply shutoff in an implement lock-out system.

Example 900 of FIG. 9 can illustrate an implement supply shutoff. The flow from implement valve 920 can travel through the implement load sense (LS) 902 to the main pump LS 908. The priority spool 918 can receive inputs from the main pump 910 and implement supply 904 and output to the steering 916. The flow from pump 910 can travel through the implement drain 912 to implement valve 920 through implement supply 904. The implement supply blocking valve 914 can close off the main flow going to the implement valve 920.

Figure 10:
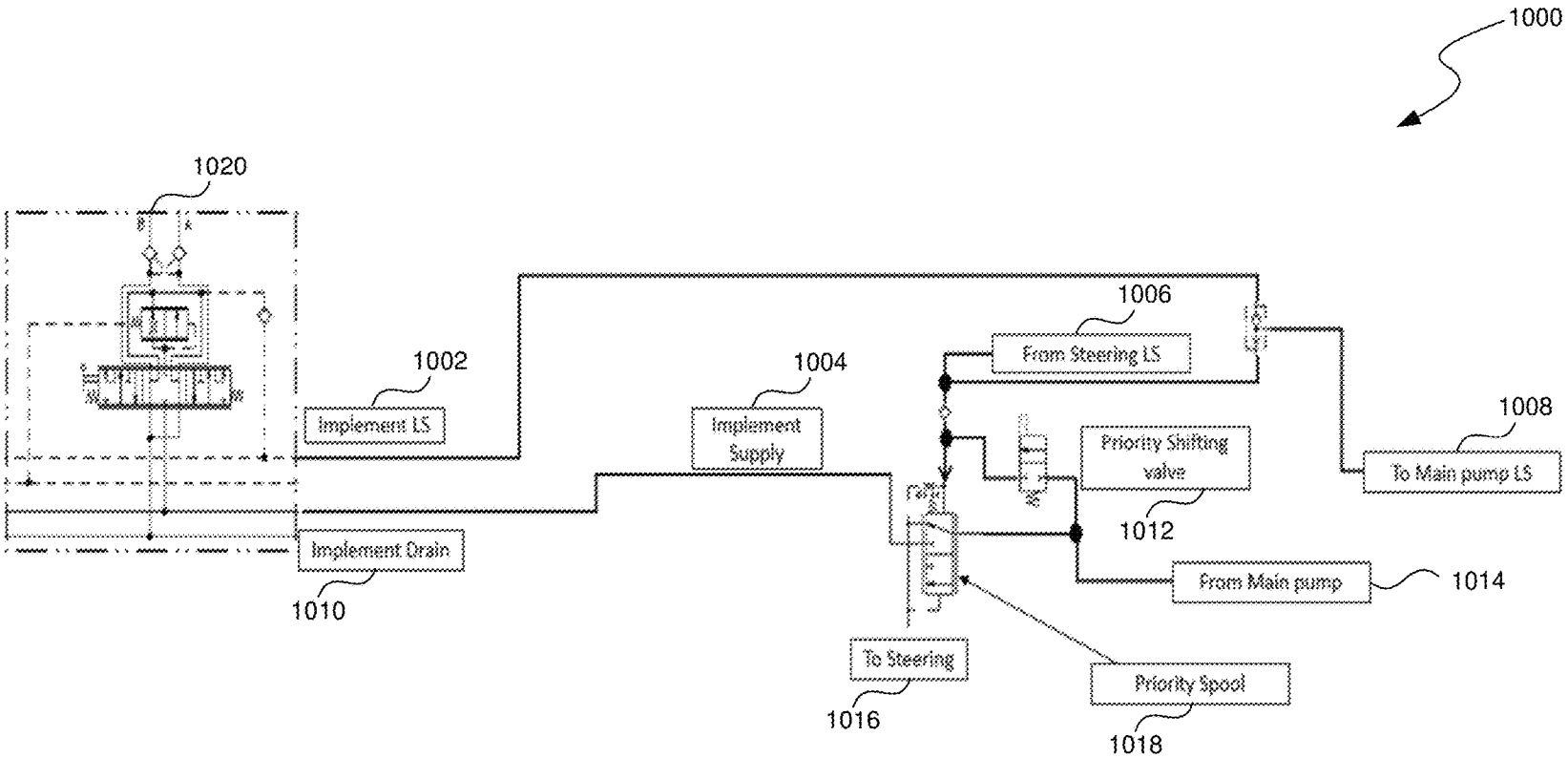
FIG. 10 is a schematic diagram illustrating an example of a priority spool control in an implement lock-out system.

Example 1000 of FIG. 10 can illustrate a priority spool control. The flow from implement valve 1020 can travel through the implement load sense (LS) 1002 to the main pump LS 1008. The priority spool 1018 can receive inputs from the main pump 1014 and implement supply 1004 and output to the steering 1016. The flow from pump 1014 can travel to implement valve 1020 through implement supply 1004. The priority shifting valve 1012 can close off the flow going to the implements and shifts the priority spool to only allow steering to receive flow.

At step 212, process 200 instructs a load sense shutoff. In a load sense shutoff, process 200 reduces the pressure or flow from the implement back to the pump which will reduce the implement pressure to a standby value. For example, during a lock-out, as an implement valve is moved (e.g., blade is raised on a machine), the lock-out system will keep the pressure low enough so the hydraulic valve does not move the implement. In a load sense shutoff, load sense or signal flow is sent from the implement back to the main pump. The machine can use variable piston pumps which take a signal and determine, based on a margin pressure, to increase flow until the margin pressure is met. The load sense shutoff can block or divert the load sense from going back to the controller on the pump. At step 214, process 200 locks-out the implement controls.

Figure 8:
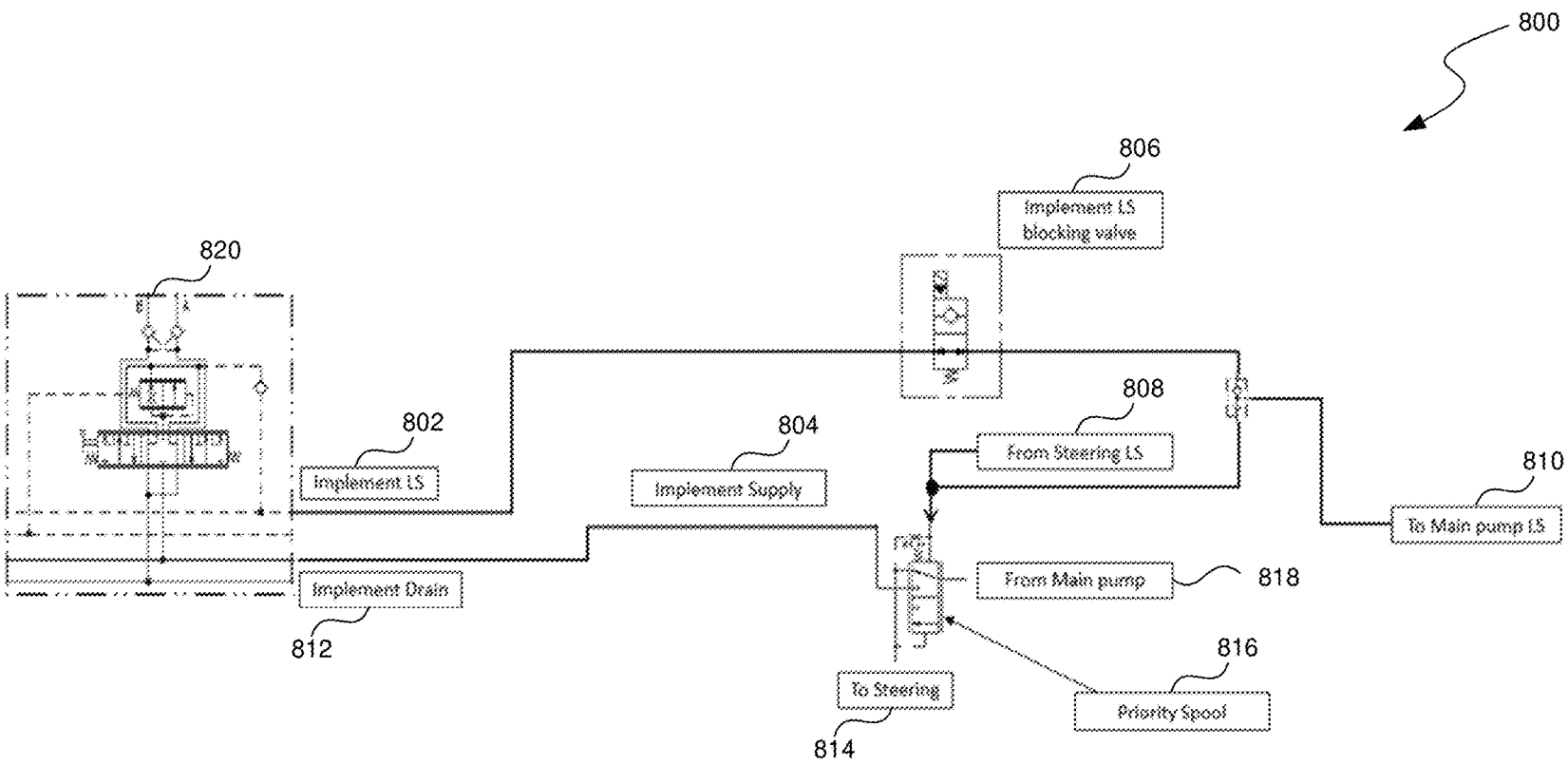
FIG. 8 is a schematic diagram illustrating an example of an implement load sense signal shutoff in an implement lock-out system.

Example 800 of FIG. 8 illustrates an implement load sense (LS) signal shutoff. The flow from implement valve 820 can travel through the implement load sense (LS) 802 to the main pump LS 810. Implement LS blocking valve 806 reduces the pressure or flow from the implement back to the pump 818. The priority spool 816 can receive inputs from the main pump 818 and implement supply 804 and output to the steering 814. The flow from pump 818 can travel to implement valve 820 through implement supply 804.

At step 216, process 200 sends a notification to the operator regarding the lock-out. The notification can be audible and/or visual to alert the operator to the implement lock-out. The notification can last the duration of the lock-out. In some embodiments, the notification indicates the duration or lock-out and provides the operator with instructions. The instructions can include steps the operator can perform to deactivate the lock-out or the duration of the lock-out.

Figure 3:
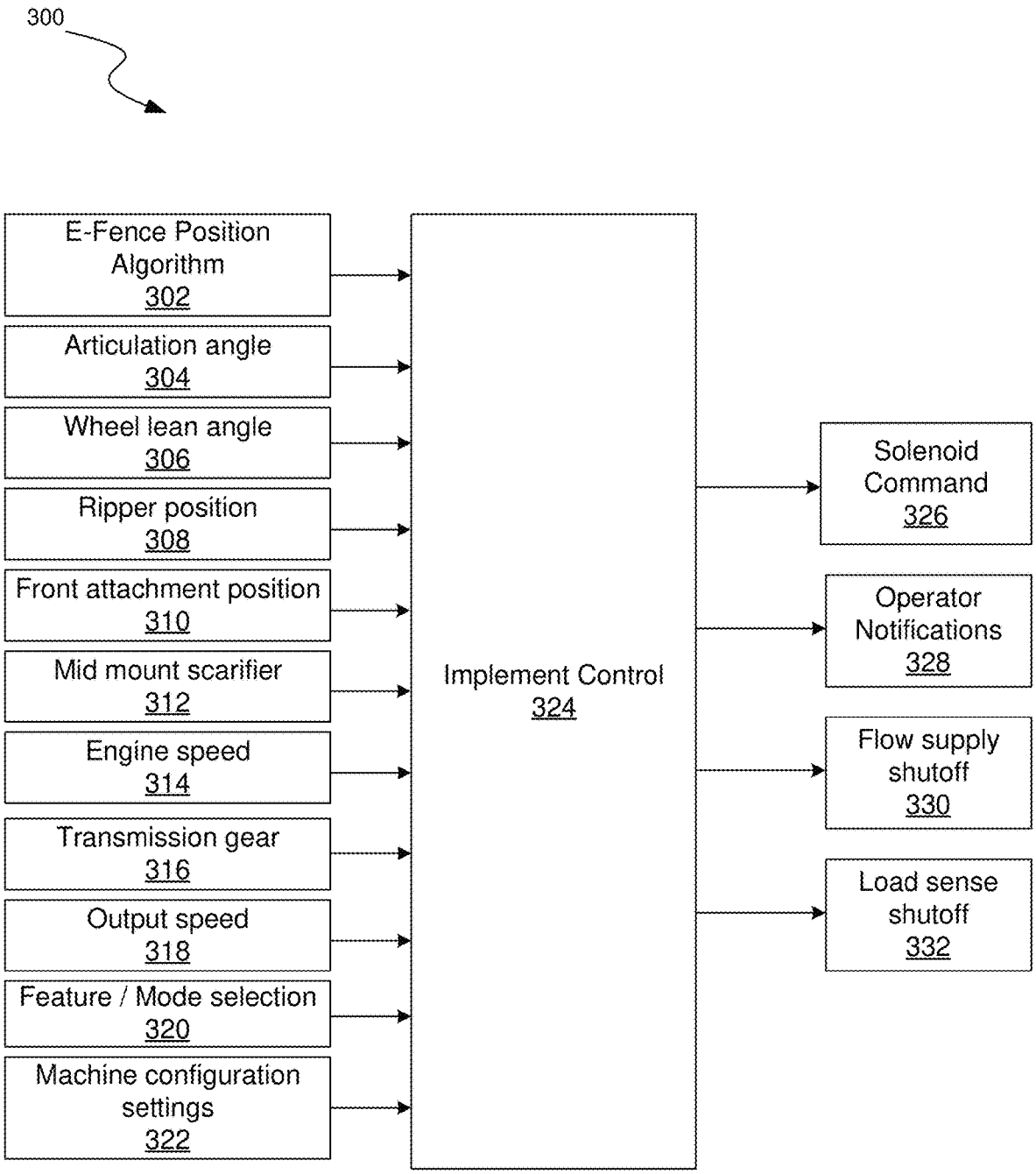
FIG. 3 is a schematic diagram illustrating an example of an implement lock-out system.

FIG. 3 is a schematic diagram illustrating example 300 of an implement lock-out system. The implement control 324 (e.g., running a control algorithm) can receive data inputs from the machine, such as one or more of E-Fence position algorithm 302, articulation angle 304, wheel lean angle 306, ripper position 308, front attachment position 310 (e.g., blade, plow, loader, etc.), mid-mount scarifier 312, engine speed 314, transmission gear 316, output speed 318, feature/mode selection 320, and machine configuration settings 322. Implement control 324 can process the data inputs and generates outputs. The outputs can include one or more of a solenoid command 326, operator notifications 328, a flow supply shutoff 330, and a load sense shutoff 332.

Figure 4:
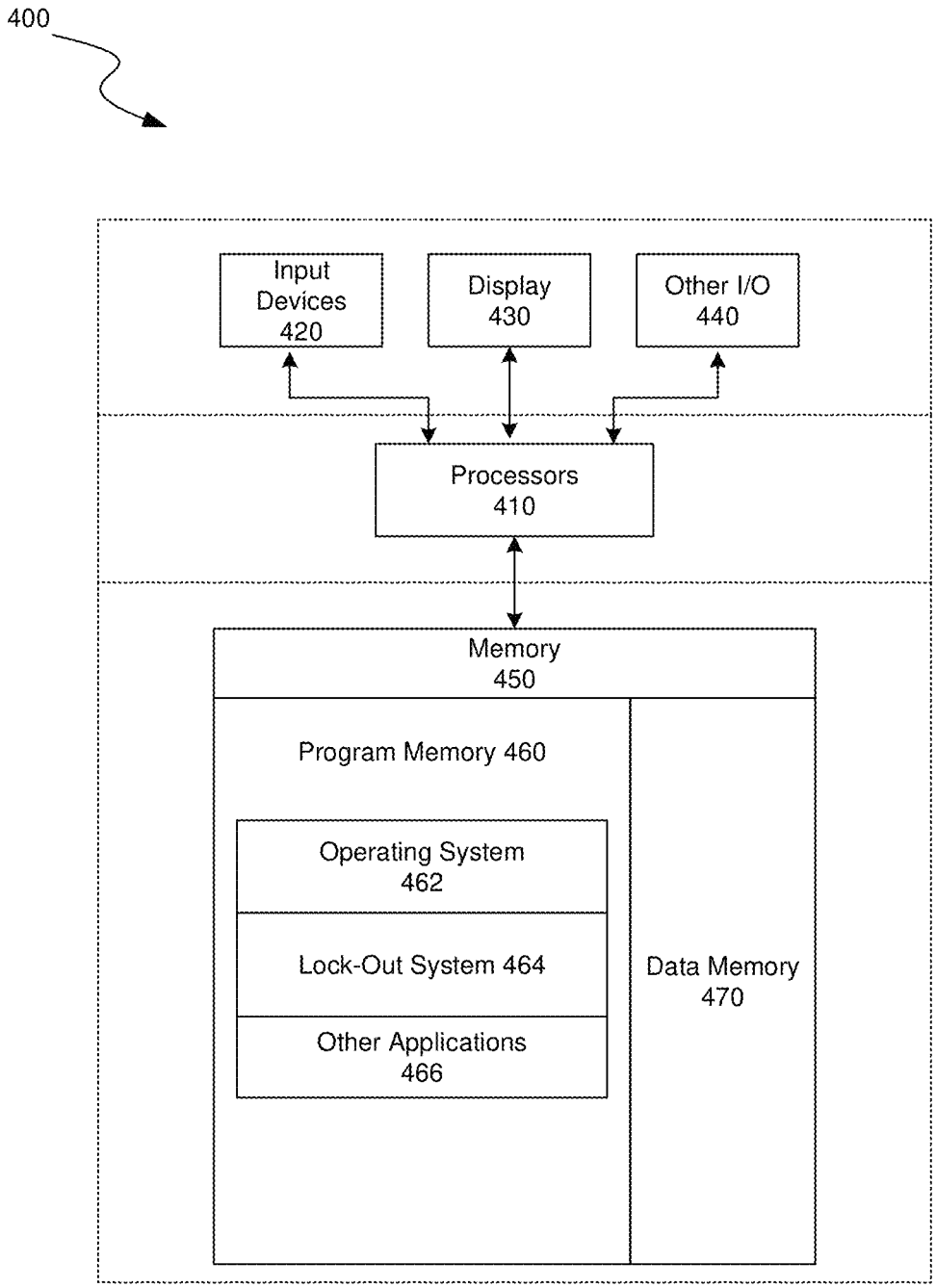
FIG. 4 is a block diagram illustrating an overview of devices on which some implementations can operate.

FIG. 4 is a block diagram illustrating an overview of devices on which some implementations of the disclosed technology can operate. The devices can comprise hardware components of a device 400 that manages entitlements within a real-time telemetry system. Device 400 can include one or more input devices 420 that provide input to the processor(s) 410 (e.g. CPU(s), GPU(s), HPU(s), etc.), notifying it of actions. The actions can be mediated by a hardware controller that interprets the signals received from the input device and communicates the information to the processor(s) 410 using a communication protocol. Input devices 420 may include, for example, a mouse, a keyboard, a touchscreen, an infrared sensor, a touchpad, a wearable input device, a camera- or image-based input device, a microphone, and/or other user input devices.

Processors 410 can be a single processing unit or multiple processing units in a device or distributed across multiple devices. Processors 410 can be coupled to other hardware devices, for example, with the use of a bus, such as a PCI bus or SCSI bus. The processors 410 can communicate with a hardware controller for devices, such as for a display 430. Display 430 can be used to display text and graphics. In some implementations, display 430 provides graphical and textual visual feedback to a user. In some implementations, display 430 includes the input device as part of the display, such as when the input device is a touchscreen or is equipped with an eye direction monitoring system. In some implementations, the display is separate from the input device. Examples of display devices are: an LCD display screen, an LED display screen, a projected, holographic, or augmented reality display (such as a heads-up display device or a head-mounted device), and so on. Other I/O devices 440 can also be coupled to the processor, such as a network card, video card, audio card, USB, Firewire or other external device, camera, printer, speakers, CD-ROM drive, DVD drive, disk drive, or Blu-Ray device.

In some implementations, the device 400 also includes a communication device capable of communicating wirelessly or wire-based with a network node. The communication device can communicate with another device or a server through a network using, for example, TCP/IP protocols. Device 400 can utilize the communication device to distribute operations across multiple network devices.

The processors 410 can have access to a memory 450 in a device or distributed across multiple devices. A memory includes one or more of various hardware devices for volatile and non-volatile storage, and can include both read-only and writable memory. For example, a memory can comprise random access memory (RAM), various caches, CPU registers, read-only memory (ROM), and writable non-volatile memory, such as flash memory, hard drives, floppy disks, CDs, DVDs, magnetic storage devices, tape drives, and so forth. A memory is not a propagating signal divorced from underlying hardware; a memory is thus non-transitory. Memory 450 can include program memory 460 that stores programs and software, such as an operating system 462, Lock-Out system 464, and other application programs 466. Memory 450 can also include data memory 470, entitlement data, user data, retrieval data, management data, authorization token data, configuration data, settings, user options or preferences, etc., which can be provided to the program memory 460 or any element of the device 400.

Some implementations can be operational with numerous other computing system environments or configurations. Examples of computing systems, environments, and/or configurations that may be suitable for use with the technology include, but are not limited to, personal computers, server computers, handheld or laptop devices, cellular telephones, wearable electronics, gaming consoles, tablet devices, multiprocessor systems, microprocessor-based systems, set-top boxes, programmable consumer electronics, network PCs, minicomputers, mainframe computers, distributed computing environments that include any of the above systems or devices, or the like.

Figure 5:
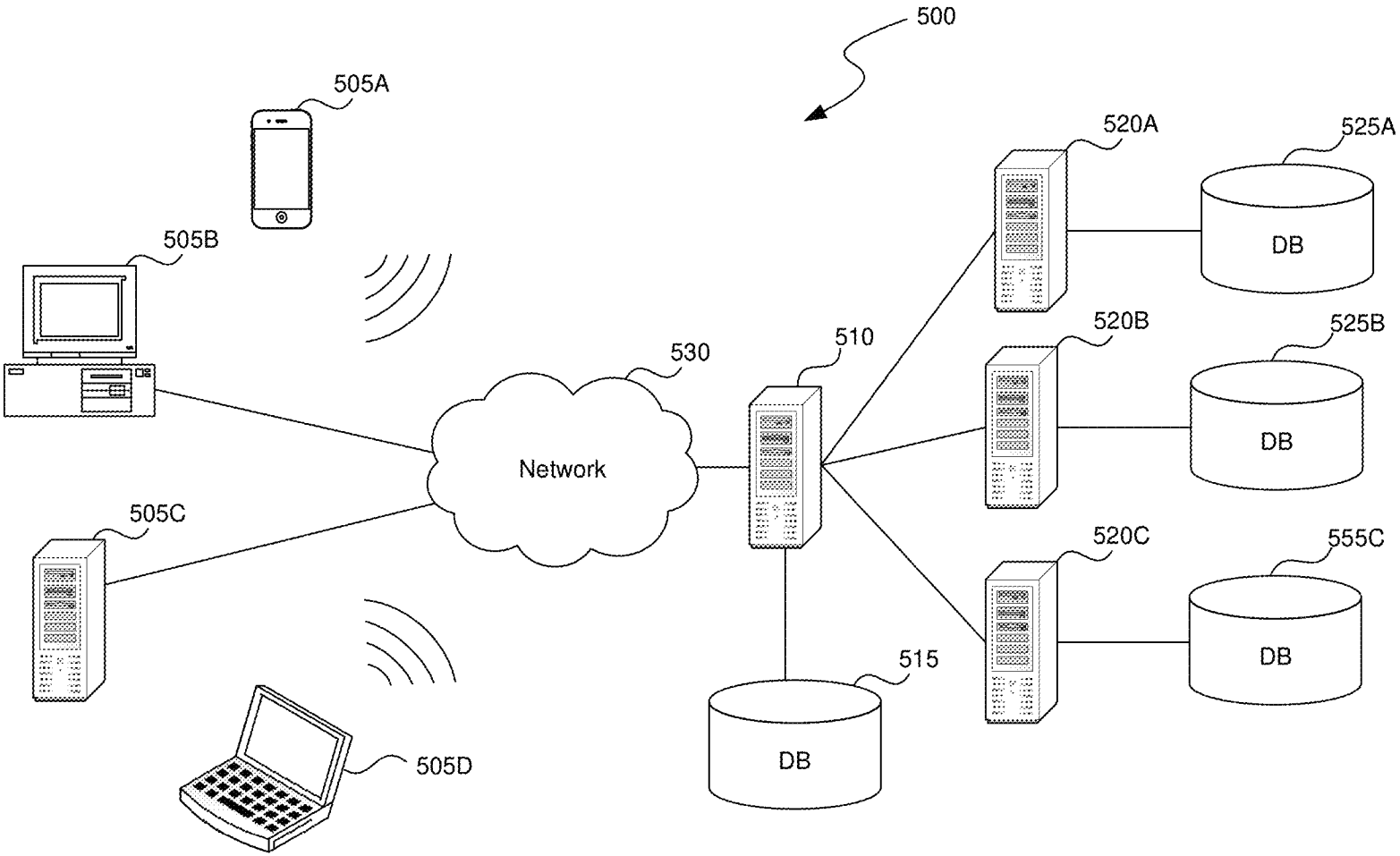
FIG. 5 is a block diagram illustrating an overview of an environment in which some implementations can operate.

FIG. 5 is a block diagram illustrating an overview of an environment 500 in which some implementations of the disclosed technology can operate. Environment 500 can include one or more client computing devices 505A-D, examples of which can include device 400. Client computing devices 505 can operate in a networked environment using logical connections through network 530 to one or more remote computers, such as a server computing device 510.

In some implementations, server 510 can be an edge server which receives client requests and coordinates fulfillment of those requests through other servers, such as servers 520A-C. Server computing devices 510 and 520 can comprise computing systems, such as device 400. Though each server computing device 510 and 520 is displayed logically as a single server, server computing devices can each be a distributed computing environment encompassing multiple computing devices located at the same or at geographically disparate physical locations. In some implementations, each server 520 corresponds to a group of servers.

Client computing devices 505 and server computing devices 510 and 520 can each act as a server or client to other server/client devices. Server 510 can connect to a database 515. Servers 520A-C can each connect to a corresponding database 525A-C. As discussed above, each server 520 can correspond to a group of servers, and each of these servers can share a database or can have their own database. Databases 515 and 525 can warehouse (e.g. store) information such as implement data, machine data, machine data, sensor data, notification data, measurement, and alert data. Though databases 515 and 525 are displayed logically as single units, databases 515 and 525 can each be a distributed computing environment encompassing multiple computing devices, can be located within their corresponding server, or can be located at the same or at geographically disparate physical locations.

Network 530 can be a local area network (LAN) or a wide area network (WAN), but can also be other wired or wireless networks. Network 530 may be the Internet or some other public or private network. Client computing devices 505 can be connected to network 530 through a network interface, such as by wired or wireless communication. While the connections between server 510 and servers 520 are shown as separate connections, these connections can be any kind of local, wide area, wired, or wireless network, including network 530 or a separate public or private network.

Figure 6:
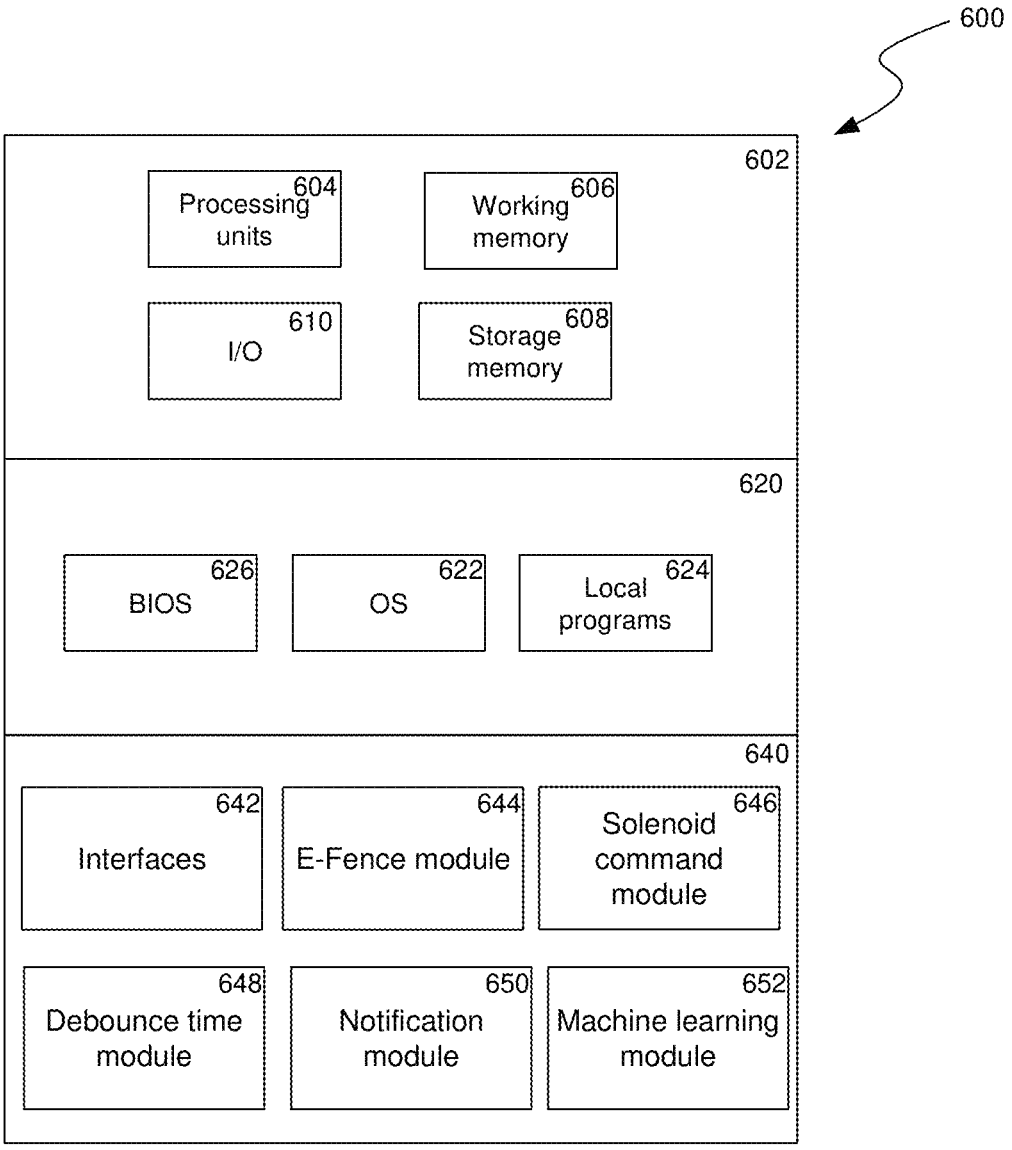
FIG. 6 is a block diagram illustrating components which, in some implementations can be used in a system employing the disclosed technology.

FIG. 6 is a block diagram illustrating components 600 which, in some implementations, can be used in a system employing the disclosed technology. The components 600 include hardware 602, general software 620, and specialized components 640. As discussed above, a system implementing the disclosed technology can use various hardware including processing units 604 (e.g. CPUs, GPUs, APUs, etc.), working memory 606, storage memory 608 (local storage or as an interface to remote storage, such as storage 515 or 525), and input and output devices 610. In various implementations, storage memory 608 can be one or more of: local devices, interfaces to remote storage devices, or combinations thereof. For example, storage memory 608 can be a set of one or more hard drives (e.g. a redundant array of independent disks (RAID)) accessible through a system bus or can be a cloud storage provider or other network storage accessible via one or more communications networks (e.g. a network accessible storage (NAS) device, such as storage 515 or storage provided through another server 520). Components 600 can be implemented in a client computing device such as client computing devices 505 or on a server computing device, such as server computing device 510 or 520.

General software 620 can include various applications including an operating system 622, local programs 624, and a basic input output system (BIOS) 626. Specialized components 640 can be subcomponents of a general software application 620, such as local programs 624. Specialized components 640 can include electronic fence (E-Fence) module 644, solenoid command module 646, debounce time module 648, notification module 650, machine learning module 652, and components which can be used for providing user interfaces, transferring data, and controlling the specialized components, such as interfaces 642. In some implementations, components 600 can be in a computing system that is distributed across multiple computing devices or can be an interface to a server-based application executing one or more of specialized components 640. Although depicted as separate components, specialized components 640 may be logical or other nonphysical differentiations of functions and/or may be submodules or code-blocks of one or more applications.

In some embodiments, the E-Fence module 644 is configured to monitor the position of an implement (e.g., blade, ripper, bucket, etc.) to detect the orientation of the implement in relation to the machine. The E-Fence module 644 can determine a threshold distance that the implement is to remain from parts of the machine. For example, the E-Fence module 644 can set the threshold distance to 6 inches (or any distance) and monitor the implement to identify if the implement enters the threshold distance. The E-Fence module 644 can monitor the parts of a machine to determine if an implement or objects (e.g., rocks, vehicles, etc.) are within a threshold distance to the machine. For example, the E-Fence module 644 defines detection zones around the machine or parts of the machine to determine if an implement or object is within a distance close enough to cause damage to the machine.

In some embodiments, the solenoid command module 646 is configured to monitor and control the hydraulic flow to the steering or implement. When a lock-out is generated, the solenoid command module 646 can lock-out the lever controls so that the operator is unable to adjust an implement. The solenoid command module 646 can maintain hydraulic flow to steering so that the operator is able to navigate the machine during the lock-out. In some implementations, the solenoid command module 646 performs similarly to a pilot command shutoff for electro-hydraulic controls.

Figure 7:
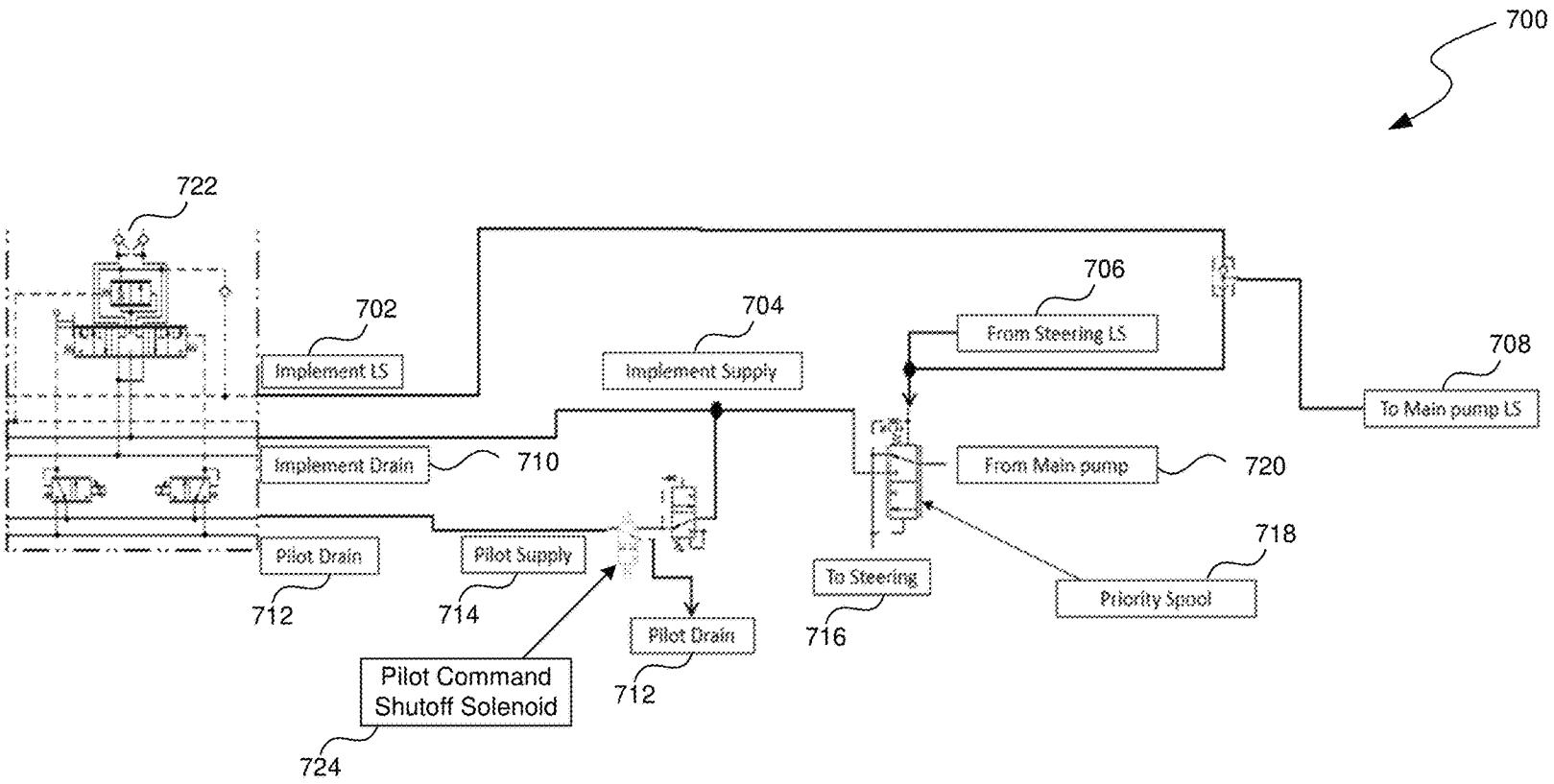
FIG. 7 is a schematic diagram illustrating an example of a pilot shutoff command in an implement lock-out system.

Example 700 of FIG. 7 illustrates a pilot command shutoff for electro-hydraulic controls. The flow from implement valve 722 can travel through the implement load sense (LS) 702 to the main pump LS 708. The priority spool 718 can receive inputs from the main pump 720 and implement supply 704 and output to the steering 716. The flow from pump 720 can travel to implement valve 722 through implement supply 704. The pilot command shutoff solenoid 724 can stop the pilot supply flow 714 and keep implement valve 722 from EH spool shifting.

In some embodiments, the debounce time module 648 is configured to generate a time threshold (e.g., any amount of time, such as seconds, minutes, etc.) for the implement lock-out. The debounce time module 648 can determine the duration of the implement lock-out based on the type of implement or the position of the implement in relation to the machine. For example, if the blade of the motor grader is within a threshold distance to a wheel, the duration of the lock-out of blade movement is long enough to allow the operator to move the machine without damaging the wheel with the implement.

In some embodiments, the notification module 650 is configured to generate and send a notification (e.g., visual or audible warning) to the operator. The notification module 650 can send a notification to the operator when an implement is within a threshold distance to the machine or part of the machine. For example, as an implement enters into a detection zone, the notification module 650 can alert the operator to adjust the implement before it damages the machine. The notification module 650 can send a notification to the operator to alert the operator of an implement lock-out. The notification can indicate the duration of the lock-out to the operator. For example, lights in the cab of the machine can blink during the lock-out and the frequency of blinking can correspond to the duration of the lock-out.

In some embodiments, the machine learning module 652 is configured to analyze the orientation of an implement on a machine and generate an implement lock-out to prevent the implement from causing damage to the machine. The machine learning module 652 may be configured to identify when to generate an implement lock-out command based on at least one machine-learning algorithm trained on at least one dataset of implement lock-out commands. The at least one machine-learning algorithms (and models) may be stored locally at databases and/or externally at databases. Machine equipment devices may be equipped to access these machine learning algorithms and intelligently identify when to generate an implement lock-out based on at least one machine-learning model that is trained on a dataset of identified lock-out events.

As described herein, a machine-learning (ML) model may refer to a predictive or statistical utility or program that may be used to determine a probability distribution over one or more-character sequences, classes, objects, result sets or events, and/or to predict a response value from one or more predictors. A model may be based on, or incorporate, one or more rule sets, machine learning, a neural network, or the like. In examples, the ML models may be located on the client device, service device, a network appliance (e.g., a firewall, a router, etc.), or some combination thereof. The ML models may process implement lock-out event databases and other data stores to determine when to generate an implement lock-out based on the orientation and position of the implement on a machine. Determining when to generate an implement lock-out may comprise identifying the distance from the machine to the implement and locking out the implement before it causes damage to the machine. Based on an aggregation of data from translated item name databases and platforms, and other user data stores, at least one ML model may be trained and subsequently deployed to automatically identify the position or orientation of the implement and generate a lock-out command before the implement damages the machine. The trained ML model may be deployed to one or more devices. As a specific example, an instance of a trained ML model may be deployed to a server device and to a client device which communicate with a machine. The ML model deployed to a server device may be configured to be used by the client device when, for example, the client device is connected to the Internet. Conversely, the ML model deployed to a client device may be configured to be used by the client device when, for example, the client device is not connected to the Internet. In some instances, a client device may not be connected to the Internet but still configured to receive satellite signals with item information, such as specific implement information based on the type of implement and machine. In such examples, the ML model may be locally cached by the client device.

Those skilled in the art will appreciate that the components illustrated in FIGS. 4-6 described above, and in each of the flow diagrams discussed below, may be altered in a variety of ways. For example, the order of the logic may be rearranged, substeps may be performed in parallel, illustrated logic may be omitted, other logic may be included, etc. In some implementations, one or more of the components described above can execute one or more of the processes described below.

INDUSTRIAL APPLICABILITY

The systems and methods described herein can implement an implement lock-out on a lever-controlled machine. The lock-out system monitors the position and orientation of the implement on a machine and locks-out the implement controls when the implement is within a threshold distance to parts of the machine. The lock-out system can generate an implement lock-out to slow, stop, or reduce the force of an hydraulic implement based on machine control logic, independent of operator input. The machine control logic can use inputs such as electronic fence (E-fence) blade position measurements, articulation angle measurements, wheel lean angle measurements, steering angle measurements, ripper position measurements, mode selection or similar data to determine when to generate the implement lock-out. The lock-out system can generate the implement lock-out by a flow supply shutoff to the implement or by a load sense shutoff. In a flow supply shutoff to the implement, the steering system still receives a flow supply, which permits the operator to maintain steering capability of the machine during the implement lockout. In a load sense shutoff, the lock-out system will reduce the pressure or flow from the implement back to the pump which will reduce the implement pressure to a standby value. In some embodiments, the lock-out system can lock-out the implement controls by a solenoid or pilot command shutoff for electro-hydraulic controls (e.g., electro-hydraulic over lever controls). For example, during a lock-out, the lock-out system keeps the spool shifted only to permit steering so that the solenoid can manually lock-out the mechanical lever controls with an electronic feature. The present systems and methods can send notifications (e.g., visual or audible) to alert the operator to the implement's proximity to the machine. The notifications can alert the operator to the implement lock-out and the duration of the implement lock-out. In some implementations, the operator activates the lock-out command on the implement controls. The present systems and methods can be implemented to manage and control multiple industrial machines, vehicles and/or other suitable devices such as mining machines, trucks, corporate fleets, etc.

Several implementations of the disclosed technology are described above in reference to the figures. The computing devices on which the described technology may be implemented can include one or more central processing units, memory, input devices (e.g., keyboard and pointing devices), output devices (e.g., display devices), storage devices (e.g., disk drives), and network devices (e.g., network interfaces). The memory and storage devices are computer-readable storage media that can store instructions that implement at least portions of the described technology. In addition, the data structures and message structures can be stored or transmitted via a data transmission medium, such as a signal on a communications link. Various communications links can be used, such as the Internet, a local area network, a wide area network, or a point-to-point dial-up connection. Thus, computer-readable media can comprise computer-readable storage media (e.g., "non-transitory" media) and computer-readable transmission media.

Reference in this specification to "implementations" (e.g. "some implementations," "various implementations," "one implementation," "an implementation," etc.) means that a particular feature, structure, or characteristic described in connection with the implementation is included in at least one implementation of the disclosure. The appearances of these phrases in various places in the specification are not necessarily all referring to the same implementation, nor are separate or alternative implementations mutually exclusive of other implementations. Moreover, various features are described which may be exhibited by some implementations and not by others. Similarly, various requirements are described which may be requirements for some implementations but not for other implementations.

As used herein, being above a threshold means that a value for an item under comparison is above a specified other value, that an item under comparison is among a certain specified number of items with the largest value, or that an item under comparison has a value within a specified top percentage value. As used herein, being below a threshold means that a value for an item under comparison is below a specified other value, that an item under comparison is among a certain specified number of items with the smallest value, or that an item under comparison has a value within a specified bottom percentage value. As used herein, being within a threshold means that a value for an item under comparison is between two specified other values, that an item under comparison is among a middle-specified number of items, or that an item under comparison has a value within a middle-specified percentage range. Relative terms, such as high or unimportant, when not otherwise defined, can be understood as assigning a value and determining how that value compares to an established threshold. For example, the phrase "selecting a fast connection" can be understood to mean selecting a connection that has a value assigned corresponding to its connection speed that is above a threshold.

Unless specifically excluded, the use of the singular above to describe a component, structure, or operation does not exclude the use of plural such components, structures, or operations.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

Although the subject matter has been described in language specific to structural features and/or methodological acts, it is to be understood that the subject matter defined in the appended claims is not necessarily limited to the specific features or acts described above. Specific embodiments and implementations have been described herein for purposes of illustration, but various modifications can be made without deviating from the scope of the embodiments and implementations. The specific features and acts described above are disclosed as example forms of implementing the claims that follow. Accordingly, the embodiments and implementations are not limited except as by the appended claims.

Any patents, patent applications, and other references noted above are incorporated herein by reference. Aspects can be modified, if necessary, to employ the systems, functions, and concepts of the various references described above to provide yet further implementations. If statements or subject matter in a document incorporated by reference conflicts with statements or subject matter of this application, then this application shall control.

We claim:

1. A computing system comprising:

one or more processors; and one or more memories storing instructions that, when executed by the one or more processors, cause the computing system to perform a process comprising:

receiving machine feature measurements for a lever-controlled machine operating at a site;

determining the machine feature measurements are within a measurement threshold;

in response to the machine feature measurements being within the measurement threshold, generating an implement lock-out of at least one hydraulic implement on the lever-controlled machine by:

maintaining a first flow supply to a steering component of the lever-controlled machine to preserve a steering capability during the implement lock-out, and stopping a second flow supply to the at least one hydraulic implement on the lever-controlled machine to prevent adjustment of the at least one hydraulic implement during the implement lock-out;

sending, to the lever-controlled machine, a notification of the implement lock-out; and disabling the implement lock-out on the lever-controlled machine after a time threshold.

2. The computing system of claim 1, the process further comprising:

determining the machine feature measurements are within a warning measurement threshold; and in response to the machine feature measurements being within the warning measurement threshold, sending, to the lever-controlled machine, a warning notification;

wherein the warning measurement threshold has a value such that the warning notification is sent before the generating of the implement lock-out.

3. The computing system of claim 1, the process further comprising:

receiving electronic fence feature position settings for the lever-controlled machine; and determining the measurement threshold based on the electronic fence feature position settings.

4. The computing system of claim 1, wherein the implement lock-out deactivates at least one hydraulic valve that controls the at least one hydraulic implement.

5. The computing system of claim 1, wherein the implement lock-out includes a load sense shutoff.

6. The computing system of claim 1, the process further comprising:

determining the measurement threshold based on input data collected from the lever-controlled machine, wherein the input data includes at least one of electronic fence blade position measurements, articulation angle measurements, wheel lean angle measurements, steering angle measurements, ripper position measurements, mode selection, or machine configuration settings.

7. The computing system of claim 1, the process further comprising:

determining a duration of the implement lock-out based on the received machine feature measurements.

8. An apparatus comprising:

a memory;

one or more processors electronically coupled to the memory and configured for:

receiving machine feature measurements for a lever-controlled machine operating at a site;

determining the machine feature measurements are within a measurement threshold;

in response to the machine feature measurements being within the measurement threshold, generating an implement lock-out of at least one hydraulic implement on the lever-controlled machine by:

maintaining a first flow supply to a steering component of the lever-controlled machine to preserve a steering capability during the implement lock-out, and stopping a second flow supply to the at least one hydraulic implement on the lever-controlled machine to prevent adjustment of the at least one hydraulic implement during the implement lock-out;

sending, to the lever-controlled machine, a notification of the implement lock-out; and disabling the implement lock-out on the lever-controlled machine after a time threshold.

9. The apparatus of claim 8, the one or more processors are further configured for:

determining the machine feature measurements are within a warning measurement threshold; and in response to the machine feature measurements being within the warning measurement threshold, sending, the lever-controlled machine, a warning notification;

wherein the warning measurement threshold has a value such that the warning notification is sent before the generating of the implement lock-out.

10. The apparatus of claim 8, wherein the one or more processors are further configured for:

receiving electronic fence feature position settings for the lever-controlled machine; and determining the measurement threshold based on the electronic fence feature position settings.

11. The apparatus of claim 8, wherein the implement lock-out deactivates at least one hydraulic valve that controls the at least one hydraulic implement.

12. The apparatus of claim 8, wherein the implement lock-out includes a load sense shutoff.

13. The apparatus of claim 8, wherein the one or more processors are further configured for:

determining the measurement threshold based on input data collected from the lever-controlled machine, wherein the input data includes at least one of electronic fence blade position measurements, articulation angle measurements, wheel lean angle measurements, steering angle measurements, ripper position measurements, mode selection, or machine configuration settings.

14. The apparatus of claim 8, wherein the one or more processors are further configured for:

determining a duration of the implement lock-out based on the received machine feature measurements.

15. A method comprising:

receiving machine feature measurements for a lever-controlled machine operating at a site;

determining the machine feature measurements are within a measurement threshold;

in response to the machine feature measurements being within the measurement threshold, generating an implement lock-out of at least one hydraulic implement on the lever-controlled machine by:

maintaining a first flow supply to a steering component of the lever-controlled machine to preserve a steering capability during the implement lock-out, and stopping a second flow supply to the at least one hydraulic implement on the lever-controlled machine to prevent adjustment of the at least one hydraulic implement during the implement lock-out;

sending, to the lever-controlled machine, a notification of the implement lock-out; and disabling the implement lock-out on the lever-controlled machine after a time threshold.

16. The method of claim 15, further comprising:

determining the machine feature measurements are within a warning measurement threshold; and in response to the machine feature measurements being within the warning measurement threshold, sending, to the lever-controlled machine, a warning notification;

wherein the warning measurement threshold has a value such that the warning notification is sent before the generating of the implement lock-out.

17. The method of claim 15, further comprising:

receiving electronic fence feature position settings for the lever-controlled machine; and determining the measurement threshold based on the electronic fence feature position settings.

18. The method of claim 15, wherein the implement lock-out deactivates at least one hydraulic valve that controls the at least one hydraulic implement.

19. The method of claim 15, wherein the implement lock-out includes a load sense shutoff.

20. The method of claim 15, further comprising:

determining the measurement threshold based on input data collected from the lever-controlled machine, wherein the input data includes at least one of electronic fence blade position measurements, articulation angle measurements, wheel lean angle measurements, steering angle measurements, ripper position measurements, mode selection, or machine configuration settings.

* * * * *